US006491253B1

(12) United States Patent
McIngvale

(10) Patent No.: US 6,491,253 B1
(45) Date of Patent: Dec. 10, 2002

(54) MISSILE SYSTEM AND METHOD FOR PERFORMING AUTOMATIC FIRE CONTROL

(75) Inventor: Pat H. McIngvale, Huntsville, AL (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 0 days.

(21) Appl. No.: 06/754,890

(22) Filed: Apr. 15, 1985

(51) Int. Cl.[7] ..... F41G 7/00; F41G 5/06

(52) U.S. Cl. ..... 244/3.11; 89/41.05; 244/3.14; 244/3.17

(58) Field of Search ..... 244/3.11, 3.14, 244/3.15, 3.16, 3.17, 3.19; 89/41.05, 36.15

(56) References Cited

U.S. PATENT DOCUMENTS

| | | | | | |
|---|---|---|---|---|---|
| 3,217,097 | A | | 11/1965 | Pauli et al. | 178/6 |
| 3,415,465 | A | * | 12/1968 | Bedford | 244/3.14 |
| 3,715,953 | A | * | 2/1973 | Allan | 244/3.16 |
| 3,718,293 | A | | 2/1973 | Willems et al. | 244/3.16 |
| 3,743,215 | A | | 7/1973 | Harris | 244/3.14 |
| 3,778,007 | A | * | 12/1973 | Kearney, II et al. | 244/3.14 |
| 3,844,506 | A | * | 10/1974 | Stavis et al. | 244/3.15 |
| 3,995,792 | A | | 12/1976 | Otto et al. | 244/3.14 |
| 4,003,659 | A | | 1/1977 | Conrad et al. | 356/152 |
| 4,004,487 | A | * | 1/1977 | Eichweber | 244/3.15 |
| 4,047,678 | A | | 9/1977 | Miller et al. | 244/3.14 |
| 4,093,153 | A | | 6/1978 | Bardash et al. | 244/3.14 |
| 4,097,007 | A | | 6/1978 | Fagan et al. | 244/3.11 |
| 4,143,835 | A | | 3/1979 | Jennings et al. | 244/3.11 |
| 4,198,015 | A | | 4/1980 | Yates et al. | 244/3.15 |
| 4,244,029 | A | | 1/1981 | Hogan et al. | 364/728 |
| 4,247,059 | A | | 1/1981 | Duke et al. | 244/3.16 |
| 4,267,562 | A | * | 5/1981 | Raimondi | 89/41.05 |
| 4,277,038 | A | | 7/1981 | Yates et al. | 244/3.15 |
| 4,386,848 | A | * | 6/1983 | Clendenin et al. | 244/3.16 |

* cited by examiner

*Primary Examiner*—Charles T. Jordan
(74) *Attorney, Agent, or Firm*—Arthur H. Tischer; Freddie M. Bush

(57) ABSTRACT

A missile system and method for performing automatic fire control in which a reconnaissance vehicle is used to gather video reference information of a target and this information is then communicated to a launching vehicle from which missiles are caused to be trained on the selected target by utilizing an automatic target handoff correlator that identifies the selected target, causes an autotracker to be locked on and finally a computer is signaled by the automatic target handoff correlator to cause a missile to be fired.

8 Claims, 3 Drawing Sheets

MISSILE SYSTEM AND METHOD FOR PERFORMING AUTOMATIC FIRE CONTROL

DEDICATORY CLAUSE

The invention described herein may be manufactured, used, and licensed by or for the Government for governmental purposes without the payment to me of any royalties thereon.

BACKGROUND OF THE INVENTION

In the past, various approaches have been taken of acquiring a target from one vehicle and attacking the target from a separate vehicle utilizing a missile. In these systems, it has not been possible to acquire a specific target desired to be destroyed and cause a missile to be placed directly on or guided directly to the target desired to be destroyed in a simple and yet accurate manner.

Therefore, it is an object of this invention to provide a system and method by which a target can be acquired at one location, data transmitted to a second location and then cause a missile to be trained and locked on the selected target.

Another object of this invention is to provide a system in which the vehicles can be camouflaged from the target and therefore be in a position from which they can be protected.

A further object of this invention is to provide a system that uses an automatic target handoff correlator that compares a reference target video to missile seeker video to insure that the missile is trained on the selected target.

Another object of this invention is to provide a system that is or can be automatic and a system that requires a minimum of personnel to operate.

Further objects and advantages of this invention will be obvious to those skilled in this art.

SUMMARY OF THE INVENTION

In accordance with this invention, a missile system and method of operating the missile system is disclosed in which a reconnaissance vehicle is used to acquire a target and to identify the target with a video camera with the target being centered in the field of view of the reconnaissance vehicle video information as well as the heading of the is reconnaissance vehicle and video camera information being transmitted to a launching vehicle through a radio frequency link to provide video reference information on the selected target to an automatic target handoff correlator and to provide the heading information of the target to a missile control computer at a launching vehicle. The launch vehicle control computer utilizes the heading data from the reconnaissance vehicle and map coordinates of its own location and provides signals for orienting missiles thereon to look in the general direction of the selected target. Each missile has a video seeker thereon that looks at the target area and provides "live" video signals to the automatic target handoff correlator which compares this "live" scene with the reference video information and picks the target out. The automatic target handoff correlator then sends signals to the video seeker of the missile to cause the seeker to be adjusted to place the target in the center of the field of view of the video seeker. When this is accomplished, the automatic target handoff correlator commands a missile autotracker on the missile to lock on to the target and the command control computer fires or causes firing of the missile and the missile is maintained on course by the missile autotracker to impact.

DESCRIPTION OF THE PREFERRED EMBODIMENTS

Figure 1:
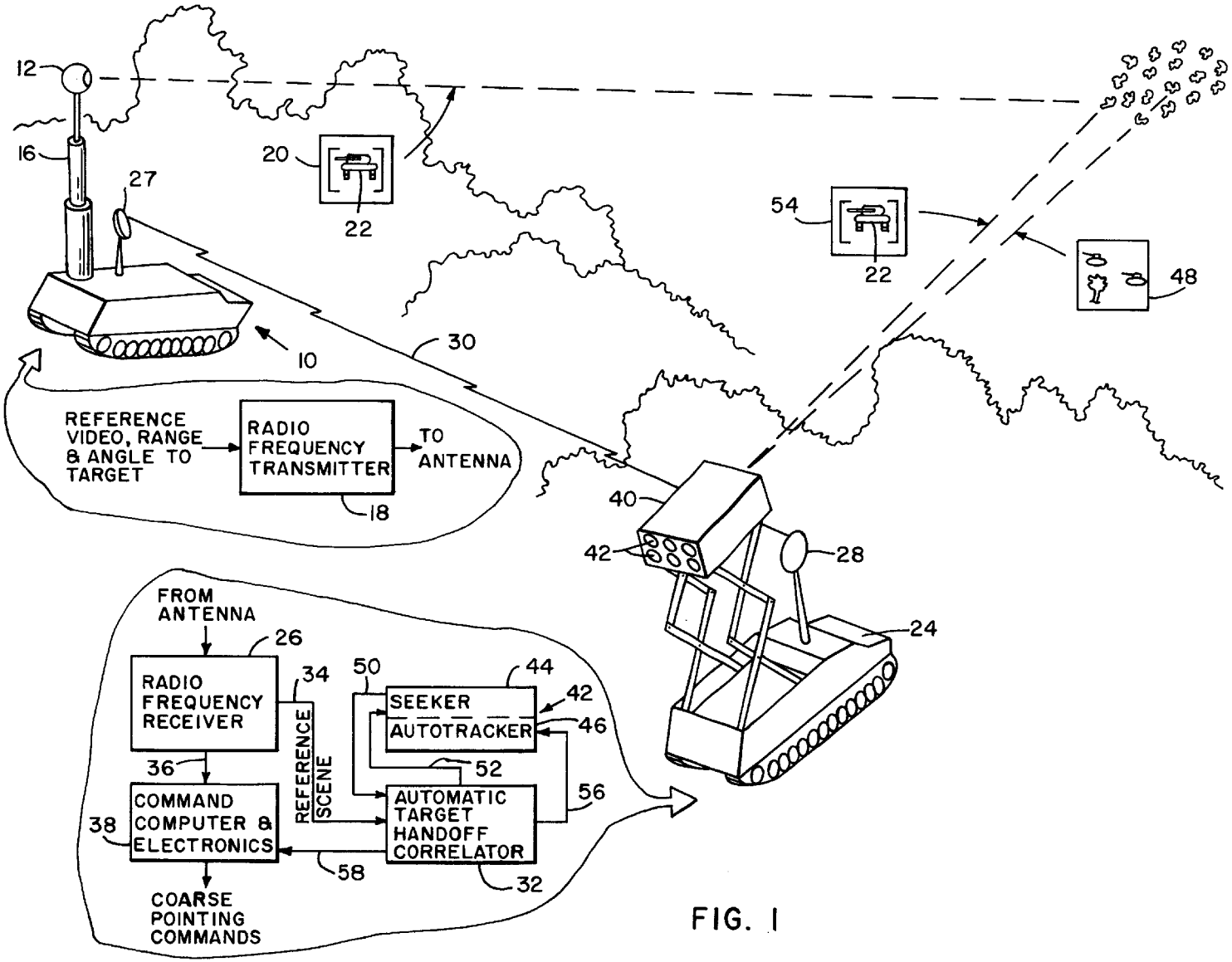
FIG. 1 is a schematic illustration of a missile system in accordance with this invention.
Figure 2:
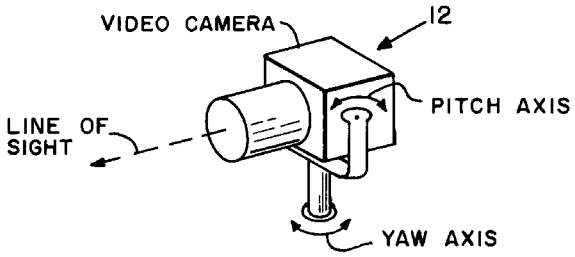
FIG. 2 is a schematic illustration of a video camera.
Figure 3:
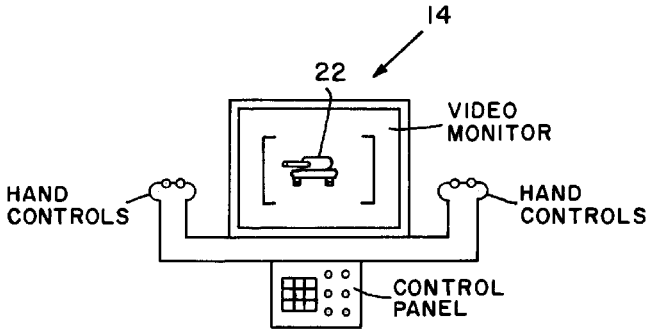
FIG. 3 is a schematic illustration of a gunner's control and display.

Referring now to the drawings, a system in accordance with this invention includes a reconnaissance vehicle 10 on which is mounted an electro-optical or a video target acquisition system of a type that has been developed for use on helicopters and other vehicles. This acquisition system includes television and/or infra-red video camera sensor 12 such as schematically illustrated in FIG. 2 and a gunner's control 14 such as schematically illustrated in FIG. 3. Gunner's control 14 is mounted on vehicle 10 in a conventional manner. This acquisition system allows precise line-of-sight acquisition of a desired target. In the system illustrated in FIG. 1, video camera 12 is mounted on a telescoping sight system 16 to allow video camera 12 to be raised above obstructions which hide vehicle 10 from potential targets. Vehicle 10 also houses a radio transmitter 18 that is designed to transmit digital data of the reference video of the scene of the selected target and the range and angle to the target data when the target has been selected. With the acquisition system in operation, video camera 12 presents to the operator/gunner a magnified, stabilized view of a target area such as illustrated at 20 on the video screen of gunner's control 14. The gunner operates his controls to cause the selected target to be centered in the field of view of his video monitoring screen. Using this magnified scene on the video screen, the gunner therefore locates a potential target, confirms that it is a target and centers the target such as illustrated at 22 in the field of view and therefore begins tracking the target. Target detection and recognition is generally performed manually in a near term system as depicted here, but as development of automatic target systems progress, one of these could be used.

Figure 4:
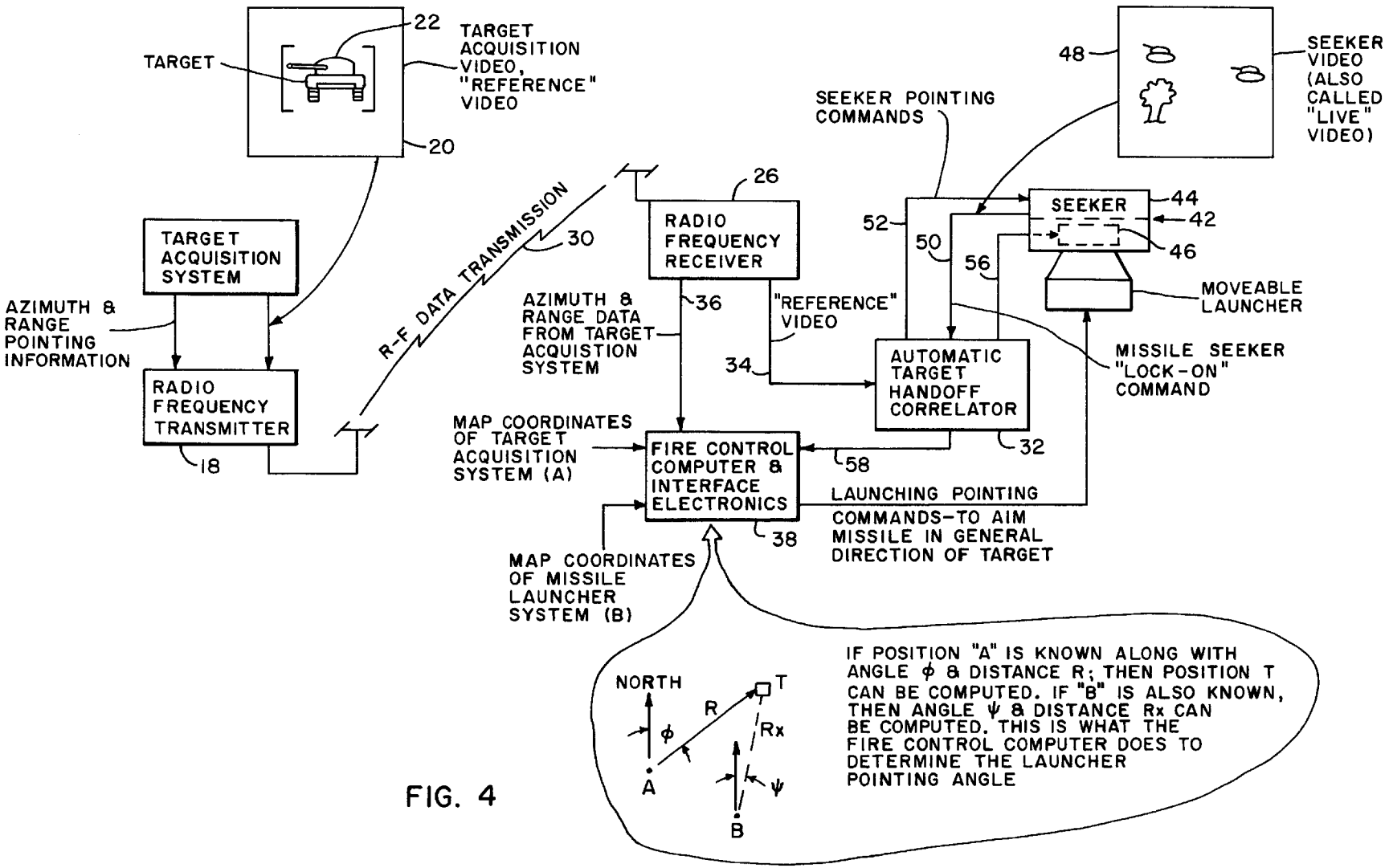
FIG. 4 is a schematic and descriptive illustration of the elements of the missile system and their innerconnection and function relative to each other.

Weapon launching vehicle 24 is designed for launching missiles to destroy the selected target and includes an RF receiver 26 that has an antenna 28 for receiving digital data from the RF transmitter on vehicle 10. The digial data to be received is the reference video data and the range and angle to target data that was gathered by the operator at vehicle 10. The data link 30 between transmitter 18 and receiver 26 therefore provides the target location information relative to vehicle 10 and the video reference information relative to the selected target. Vehicle 24 in addition to housing radio frequency receiver 26 includes an automatic target handoff correlator 32 that is connected through connection 34 to RF receiver 26 for receiving the referenced video information from reconnaissance vehicle 10 by way of link 30. This reference video information is stored in automatic target handoff correlator 32. Also, the heading information of vehicle 10 relative to selected target 22 is transmitted through link 30 to RF receiver 26, connection 36 and to fire control computer 38. Fire control computer 38 has map coordinates information relative to reconnaissance vehicle 10 loaded therein as well as map coordinates information relative to launching vehicle 24 loaded therein. With this information, fire control computer 38 utilizes the heading information from reconnaissance vehicle 10 to compute launcher pointing comands to aim a missile in the general direction of the selected target. This course launcher pointing command from fire control computer 38 causes missile container 40 to be elevated and oriented from launch vehicle 24 to point one of the multiplicity of missiles 42 therein in the general direction of the selected target. Each missile 42 has a video seeker 44 in the nose thereof and a missile autotracker 46 therein (see FIGS. 1 and 4). When seeker 44 has been elevated and pointed in the general direction of the selected target by launch vehicle 24, seeker 44 gathers video information of the target scene such as illustrated at scene 48 and this information is communicated by connection 50 to automatic target handoff correlator 32 which compares this video scene with the reference video scene and locates the selected target somewhere within the field of view as viewed from scene 48. The automatic target handoff correlator then produces seeker pointing commands that are communicated through connection 52 to seeker 44 to null out error between center of the seeker video and location of target from reference video in order to center the selected target in the field of view to a scene such as illustrated at 54 (see FIG. 1) which shows target 22 to be centered therein. Once seeker 44 has been adjusted to place selected target 22 in the center of the field of view, automatic target handoff correlator 32 recognizes this and commands through connection 56 automatic tracker 46 to lock on and take over control of pointing commands to seeker 44 and guidance of missile 42 to its selected target. When autotracker 46 has been locked on, automatic target handoff correlator 32 can command through connection 58 to fire control computer 38 that the selected missile 42 be automatically fired at the selected target or this signal can be used to advise a launching vehicle operator that the missile is locked on and ready for firing and the operator can then fire the missile by the flip of a switch (not shown). The missile is then guided to the target by missile autotracker 46 which causes the missile to be guided to the target. An automatic target handoff correlator that can be used in a system as disclosed here is a correlator such as disclosed in U.S. Pat. No. 4,244,029 by Hogan et al, Jan. 6, 1981. Of course, more sophisticated automatic target handoff correlators could be used as devices of this type are currently being improved.

In operation, with reconnaissance vehicle 10 and launching vehicle 24 hidden from enemy targets by obscuring terrain features or vegetation, the target desired to be located or acquired is located by camera 12 and centered in gunner's control 14 as a target that is desired to be acquired. This operation is done by the gunner control and when the target has been selected, the reference video of the target is now ready as well as the range and angle to the target (heading information) from reconnaissance vehicle 10 relative to the target. This reference video as digital data, as well as the range and angle of target as digital data is transmitted from radio frequency transmitter 18 on vehicle 10 to radio frequency receiver 26 on vehicle 24 through antennas 27 and 28. The radio frequency receiver then communicates the reference video information through connection 34 to automatic target handoff correlator 32 that stores the reference video. Radio frequency receiver 26 also communicates through connection 36 to fire control computer 38 the range and angle to target data, and fire control computer 38 has preprogramed therein the map coordinates relative to the position of vehicle 10 and vehicle 24 and these three reference data are used by computer 38 to produce signals to cause vehicle 24 to be commanded and the missiles to be raised and oriented relative to launcher 24 and directed in the general direction of the selected target. With missile container 40 elevated and oriented to place missiles 42 in a line of sight to the target, missile seeker 44 is initiated by command from the fire control computer or by other appropriate means and seeker 44 produces a seeker video such as illustrated at 48 and this video scene is communicated through connection 50 to automatic target handoff correlator 32 that digitially compares the reference scene to the "live" scene from seeker 44. After proper preprocessing, such as digitizing the analog video, cleaning noise from the video, adjusting the scene factors of the two images to make them the same size, detecting and enhancing edges and etc., the point of the best match between the target and the reference video and the live scene seeker video is found. This is the point in the missile seeker live image that best matches the reference video image and is, of course, the desired target. When this match point is found, the automatic target handoff correlator 32 computes the location with respect to the center of the field-of-view and uses this to generate a command that is transmitted through connection 52 to drive seeker 42 gimbals so that the desired target will be centered in the field-of-view of seeker 44. When this has been accomplished, automatic target handoff correlator 32 which receives an additional video scene through connection 50 verifies that the proper target is in the center of the field-of-view and then sends a signal through connection 56 to automatic tracker 46 to cause automatic tracker 46 to lock on. After this has been accomplished, missile 42 is then either automatically fired by a signal being sent from automatic target handoff correlator 32 through connection 58 to fire control computer 38 that sends a signal to missile 42 to cause firing of the missile. If desired, a missile operator/gunner located at launcher vehicle 24 can be notified by fire control computer 38 and the missile operator can flip a switch (not shown) which causes missile 42 to be fired. Once the missile is fired, automatic tracker 46 causes missile 42 to be guided to the target.

Although this invention is shown applied to two-tracked vehicles having means of elevating the target acquisition system and weapons canister launcher with the missiles therein above obscuring terrain, it is equally applicable to a wide variety of other vehicles where initial target acquisition is performed on one vehicle and the target is handed over to another vehicle for attack. For example, target acquisition can be provided by a mobile means while the missiles are mounted along with the fire control equipment on an automated fire installation. Likewise, the target acquisition could be performed by a scout helicopter with a mast mounted sight and the target could be handed off to a second helicopter carrying the missiles with the launching equipment.

Figure 5:
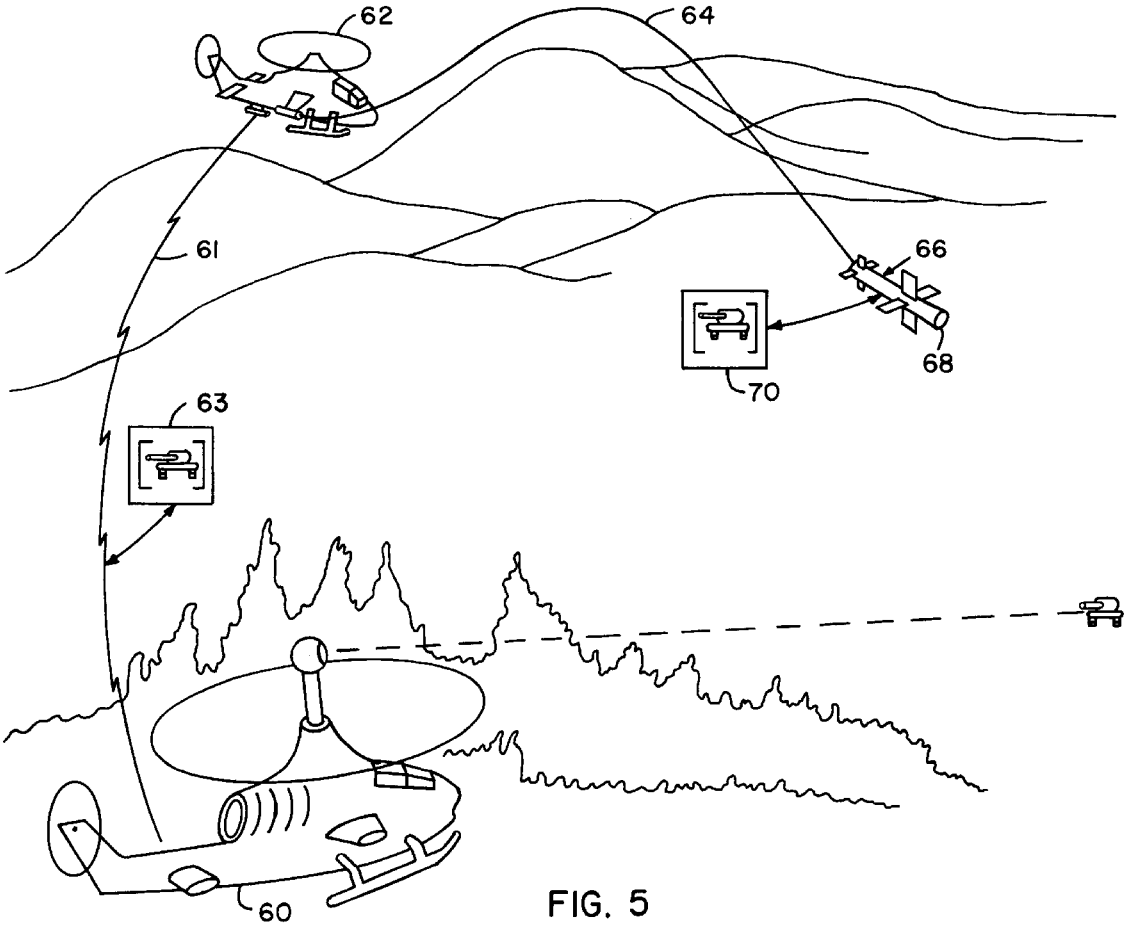
FIG. 5 is a schematic and pictorial representation of a modified missile system in accordance with this invention.

Another variation of the system disclosed hereinabove is illustrated in FIG. 5. In this variation, the target is acquired by a scout helicopter 60 which has the same equipment as shown for reconnaissance vehicle 10. A second helicopter 62 is equipped with the launching equipment of launching vehicle 24. In this particular system, the automatic tracker is located on the helicopter and communicates through fiber optics cable communication link 64 to missile 66 and video seeker 68 in the nose thereof. Helicopter 62 has the same equipment as launching vehicle 24 except that it can also include the automatic target tracker in addition rather than the automatic target tracker being on the missile itself. In this embodiment, the automatic target tracker can be on helicopter 62 or on missile 66.

In operation with this application, scout helicopter 60 acquires the target and transmits via radio frequency link 61 the heading and range to target along with the reference video information 63. The fire control computer of the system located on helicopter 62 calculates approximate heading and range to the target from the weapons helicopter and the missile is fired. As missile 66 flies, its "live" video scene 70 is transmitted back to helicopter 62 and control commands are transmitted to missile 66 via fiber optic link 64. That is, signals from missile seeker 68 as well as to missile 66 are communicated via fiber optic link 64. When missile 66 gets in the target area of field of view, the automatic target handoff correlator located on vehicle 62 then compares "live" seeker video in the same way as described for the system of FIG. 1. The missile seeker is finally centered in the field of view of the target and the automatic target tracker is then commanded to take over and cause missile 66 to be directed to the target.

The major components of this invention, such as the target acquisition system, the imaging missile seekers, the radio frequency transmitters and receivers, the fire control computer, and the automatic target handoff correlator have all been built and made readily available. The invention here is the unique system for combining and/or method of utilizing these components in a unique automatic fire control system that can be used to rapidly and accurately handoff targets to attack or weapons vehicles in such a way as to improve the servicability of the weapons vehicles and increase the effectiveness against point targets. In the past, manual operaters have not been able to effectively match reference and live scene images adequate for effective attack and control.

I claim:

1. A method of acquiring and attacking a target comprising: acquiring a target desired to be destroyed on a video camera of a reconnaissance vehicle and imaging the target in the field of view of the video camera on a display screen, transmitting reference video image signal data of the imaged target by a radio frequency link between a reconnaissance vehicle and a launching vehicle, transmitting the heading of the reconnaissance vehicle and video camera relative to the target through the radio frequency link to said launching vehicle, storing the reference video image signal data in an automatic target handoff correlator, and storing the heading information from the reconnaissance vehicle in a fire control computer, providing map coordinate information of the relative position of the launching vehicle and the reconnaissance vehicle to said fire control computer, utilizing the map coordinate information and the heading information in said fire control computer and computing the direction of the selected target from the launching vehicle to produce computed direction information, sending said computed direction information to said launching vehicle and directing a missile that has a video seeker therein to a line of sight of said selected target, obtaining seeker "live" video image information of said selected target and transmitting the "live" video image seeker information to said automatic target handoff correlator, comparing in said automatic target handoff correlator the "live" video image seeker information with said reference video image signal data and producing error signals, utilizing the error signals to adjust the video seeker and place the selected target in the center of the field of view of the video seeker, utilizing said automatic target handoff correlator to verify that the target is in the center of the field of view of the video seeker, utilizing said automatic target handoff correlator to then command a missile autotracker to lock on said target and guide said missile through the utilization of video signals from said video seeker to impact with said selected target.

2. A method as set forth in claim 1, and further comprising acquiring said target from said reconnaissance vehicle in a camouflaged position, placing said missile in the line of sight to the selected target by said missile being elevated and oriented from the launching vehicle in a camouflaged position to place the video seeker in the field of view of the selected target.

3. A method as set forth in claim 2, and further comprising firing said missile from said launching vehicle after the missile has been elevated into position on its launching vehicle.

4. A method as set forth in claim 1, and further comprising operating said video camera of a reconnaissance vehicle from an airborne position.

5. A missile system for performing automatic fire control comprising a reconnaissance vehicle having a video camera and gunner's control mounted thereon for acquiring a target, a radio frequency data link transmitter on said reconnaissance vehicle, a launching vehicle and having a radio frequency receiver thereon for receiving data from said radio frequency transmitter, said launching vehicle having missiles thereon, said launching vehicle also containing an automatic target handoff correlator and a command control computer with innerconnecting electronics, said gunner's control being connected to said radio frequency transmitter for transmitting acquisition data from said radio frequency transmitter to said radio frequency receiver and said radio frequency receiver being connected for connecting heading information to said command computer and reference video information from said gunner's control to said automatic target handoff correlator, said missiles each having a video seeker therein and a missile autotracker connected for causing its respective missile to be guided to a selected target, said video seeker being connected to said automatic target handoff correlator and providing live video image information to said automatic target handoff correlator which correlates the reference video information with the "live" video image information and produces correction signals that are communicated to the seeker to cause the seeker to be centered in the field of view of the selected target, said automatic target handoff correlator also being connected to said autotracker and commanding said autotracker to lock on after said target has been centered in the field of view of the video seeker, said automatic target handoff correlator also being connected to said command computer an d said automatic target handoff correlator sending a signal to said command computer for firing said selected missile after said autotracker has been locked on.

6. A missile system for performing automatic fire control as set forth in claim 5, wherein said reconnaissance vehicle acquires target from a camouflaged position, wherein said launching vehicle is in a camouflaged position and said selected missile is placed in a line of sight to the selected target by being elevated and oriented from the launching vehicle to place the video seeker of the missile in the field of view of the selected target.

7. A missile system for performing automatic fire control as set forth in claim 6, and further comprising firing said missile from said launcher after the selected missile has been elevated and oriented into position in its launching vehicle.

8. A missile system for performing automatic fire control as set forth in claim 5, wherein said acquisition video camera is on an airborne reconnaissance vehicle and is positioned therefrom to acquire the selected target.

* * * * *